US005611645A

United States Patent [19]

Breeden

[11] Patent Number: 5,611,645

[45] Date of Patent: Mar. 18, 1997

[54] OFFSHORE JACK-UP RIG LOCKING SYSTEM

[76] Inventor: John Breeden, 810 N. Beach Blvd., Bay St. Louis, Miss. 39520

[21] Appl. No.: 541,162

[22] Filed: Oct. 11, 1995

Related U.S. Application Data

[62] Division of Ser. No. 254,121, Jun. 6, 1994, Pat. No. 5,486, 069.

[51] Int. Cl.[6] ..... E02B 17/00; E02B 17/06

[52] U.S. Cl. ..... 405/196; 405/198; 405/195.1

[58] Field of Search ..... 405/198, 196, 405/195.1, 197, 199, 200; 254/105–112

[56] References Cited

U.S. PATENT DOCUMENTS

| | | | |
|---|---|---|---|
| Re. 29,539 | 2/1978 | Willke et al. | 254/89 R |
| 2,308,743 | 1/1943 | Bulkey et al. | 175/9 |
| 3,183,676 | 5/1965 | Tourneau . | |
| 3,290,007 | 12/1966 | Yeilding | 254/106 |
| 3,606,251 | 9/1971 | Willke et al. | 254/89 |
| 3,945,450 | 3/1976 | Wilson et al. | 180/8 R |
| 3,967,457 | 7/1976 | Lovie . | |
| 4,073,155 | 2/1978 | Schiemichen . | |
| 4,195,950 | 4/1980 | Goldman | 405/195 |
| 4,199,276 | 4/1980 | Molsberger | 405/198 |
| 4,255,069 | 3/1981 | Yielding | 405/196 |
| 4,269,543 | 5/1981 | Goldman et al. | 405/196 |
| 4,422,802 | 12/1983 | Choate | 405/198 |
| 4,437,792 | 3/1984 | Durand et al. | 405/198 |
| 4,445,805 | 5/1984 | Ray et al. | 405/203 |
| 4,453,858 | 6/1984 | Guiader | 405/198 |
| 4,479,401 | 10/1984 | Korkut | 74/527 |
| 4,497,591 | 2/1985 | Gillis | 405/198 |
| 4,505,616 | 3/1985 | Grzelka et al. | 405/198 |
| 4,521,134 | 6/1985 | Schoonmade | 405/198 |
| 4,538,938 | 9/1985 | Grzelka et al. | 405/198 |
| 4,574,650 | 3/1986 | Durand et al. | 74/411.5 |
| 4,583,881 | 4/1986 | Steele | 405/198 |
| 4,589,799 | 5/1986 | Hotta et al. | 405/196 |
| 4,627,768 | 12/1986 | Thomas et al. | 405/198 |
| 4,655,640 | 4/1987 | Gillis | 405/198 |
| 4,657,437 | 4/1987 | Breeden | 405/198 |
| 4,657,438 | 4/1987 | Gillis | 405/198 |
| 4,662,787 | 5/1987 | Tatsuguchi | 405/198 |
| 4,668,127 | 5/1987 | Steele | 405/198 |
| 4,740,108 | 4/1988 | Levee et al. | 405/221 |
| 4,744,698 | 5/1988 | Dallimer et al. | 405/226 |
| 4,813,814 | 3/1989 | Shibuta et al. | 405/198 |
| 5,139,366 | 8/1992 | Choate et al. | 405/198 |

FOREIGN PATENT DOCUMENTS

| | | | |
|---|---|---|---|
| 0056753 | 11/1982 | European Pat. Off. . | |
| 2523-612 | 9/1983 | France | 405/196 |
| 2736938 | 7/1978 | Germany | 405/198 |

*Primary Examiner*—Dennis L. Taylor
*Attorney, Agent, or Firm*—Pravel, Hewitt, Kimball & Krieger

[57] ABSTRACT

A fixation system which can be automatically engaged or disengaged from a remote control room as well as from a local at each fixation unit. The fixation system that uses a toothed chord chock which is vertically movable to match the elevation of the leg chord rack teeth and horizontally movable to engage the teeth of leg chord. The toothed chord chock has upper and lower inclined surfaces. A fixation system which includes an upper and lower wedge which rides on upper and lower fixed inclined surfaces. The upper and lower wedges can be moved to engage the upper and lower inclined surfaces of the tooth chock.

14 Claims, 5 Drawing Sheets

OFFSHORE JACK-UP RIG LOCKING SYSTEM

This application is a division of application Ser. No. 08/254,121, filed Jun. 6, 1994, now U.S. Pat. No. 5,486,069.

BACKGROUND OF THE INVENTION

1. Field of the Invention

The present invention relates to a locking system for mobile, offshore self elevating "jack-up units" or "jack-up rigs" that are commonly used in the offshore oil industry. More particularly the present invention relates to an improved system for locking the legs and barge of a jack-up rig once the legs are in a lowered, and the hull is elevated to an operating position, (also afloat when the hull is being towed) wherein a pair of opposed actuators thrust a movable toothed chock member that fits a similar, corresponding set of teeth on the jack-up rig leg. After the pair of opposed movable toothed chock members are in place then the upper and lower wedge shaped locking members that cooperates with a pair of fixed, rigid wedged shaped locking members that are a part of the barge structure are individually moved into a locked position with the toothed chock members.

2. General Background

A "jack-up unit" or "jack-up platform" refers to any type of floating barge having a deck working platform and extendable legs used to engage the seabed and to elevate the barge or hull above the seabed. Jack-up units are used for the drilling of oil and gas wells, the production of oil and gas from wells, and related other tasks such as for example work over, maintenance, surveys and the like.

Jack-up rigs typically use three or four movable legs, each independently movable with respect to a barge or hull portion that floats. The plurality of legs can be lowered to engage the ocean floor. Jacking mechanisms then elevate the barge above the water surface. During this operation, the bottom of the legs engage the sea bottom for support, Jack-up rigs can thus relocate from one site to another site by simply elevating the legs once a job is completed, lowering the barge to the water's surface. The barge then floats with the legs extended above the barge deck. The floating barge can then be moved to a new job site and raised to an elevated position for its next duty.

An example of a jack-up platform can be seen in U.S. Pat. No. 4,657,437 issued to applicant herein, John O. Breeden and entitled "Mobile Offshore Self-Elevating Jackup Support System with Adjustable Leg Inclination and Fixation". U.S. Pat. No. 4,657,437 is hereby incorporated herein by reference.

Most commercially available jack-up rigs employ a pinion drive jacking system. This jacking system includes a plurality of rotary pinion gears that are powered. Each of the pinion gears engages a toothed rack that extends linearly along a jack-up rig leg. There may be multiple rows of teeth on each leg, and multiple pinion gears for engaging these toothed rack sections.

Jack-up units have been equipped with rack and pinion type jacking systems for many years. Examples, include U.S. Pat. No. 2,308,743 issued Jan. 19, 1943 to W. Bulkey et al.; U.S. Pat. No. 3,183,676 issued May 18, 1965 to R. LeTourneau; U.S. Pat. No. 3,606,251 issued Sep. 20, 1971 and Reissue patent U.S. Pat. No. RE29,539, owned by Armco Steel Corporation, and U.S. Pat. No. 4,813,814 entitled "Leg Holding Device for Offshore Platform".

Many other patents further illustrate the art relating to jack-up units and related structures. U.S. Pat. No. 4,813,814 provides a leg-holding device for offshore platform. U.S. Pat. No. 4,744,698 provides a method and apparatus for installing marine silos. U.S. Pat. No. 4,740,108 discloses a method and apparatus for selecting and maintaining the level of a pier deck. U.S. Pat. No. 4,668,127 provides a mobile, offshore, jack-up marine platform adjustable for sloping sea floor. U.S. Pat. No. 4,662,787 discloses a locking device for locking offshore work platform to leg chord used for lifting work platform. U.S. Pat. No. 4,657,438 provides an advancing mechanism and system utilizing same for raising and lowering a work platform.

U.S. Pat. No. 4,655,640 provides an advancing mechanism and system utilizing same for raising and lowering a work platform U.S. Pat. No. 4,627,768 relates to a locking device for oil platforms. U.S. Pat. No. 4,589,799 relates to a device for locking platform of an offshore structure. U.S. Pat. No. 4,583,881 provides a mobile offshore jack-up marine platform adjustable for a sloping sea floor. U.S. Pat. No. 4,574,650 relates to a force limiting gear reducer for the lifting pinion of a self-elevating platform. U.S. Pat. No. 4,538,938 provides an adjustable locking chock system. U.S. Pat. No. 4,521,134 provides an elevating device for an artificial island or work platform. U.S. Pat. No. 4,505,616 provides a self-locking chock system for a jack-up rig unit.

U.S. Pat. No. 4,497,591 provides an advancing mechanism and system utilizing same for raising and lowering a work platform.

One of the problems encountered by locking systems for jack-up rigs is the problem of severe loads that are encountered in rough weather conditions. Rough weather conditions create "storm loads" on leg racks that often exceed the rating or holding capacity of the elevating jacks. In these conditions, the loads must be transferred directly between the hull or barge structure and the legs with a separate locking system. These high stresses often take the form of extreme bending moments that can freeze the locking mechanism to a degree that leg movement is thereafter difficult or impossible. The present locking systems are not suitable and/or made for automatic operations and require many man-hours to install or remove. Existing locking system suffer in that they require visual identification that the locking elements are aligned before locking can occur.

SUMMARY OF THE INVENTION

The present invention provides an improved method and apparatus for fixation of jack-up rig legs and hull that is suitable for complete automatic, computer controlled, operation from a control room as well as local operation from a console adjacent the locking mechanism.

The jack towers referred to herein may be fixed to the hull such as used for vertical leg jack up units or may be fixed to a frame which rotates such as used for slanted leg jack up units, the frame is fixed to the hull.

The apparatus includes a plurality of pinion gears supported upon the hull adjacent each of the legs of the jack-up rig for engaging the toothed rack of each leg. The pinion gears can be powered to raise the hull relative to the legs when the pinions rotate and are engaged with the toothed racks of the legs.

First and second extensible actuator rams are associated with each leg and positioned to travel between retracted and extended positions. Each of the rams has a first end portion that is movably connected to the hull and a second end portion with a wedge member. Each wedge member provides a pair inclined of bearing surfaces thereon that define an acute angle. The extended position places these wedges close to the toothed rack.

The hull has a pair of fixed wedge supports that are positioned above and below pair of extensible actuator rams. Each wedge support has a single inclined bearing surface. A third extensible actuator ram is movable between extended and retracted positions, and is independently movable with respect to the first two rams. The third ram carries a chock with teeth for fitting the teeth of the toothed leg rack prior to loading. During loading, the first and second extensible rams move into the extended position wherein they will slide against the upper and lower wedge shaped supports that are rigidly attached to the hull. The wedges also engage inclined surfaces on the toothed member. The wedges in the disengaged position are withdrawn thereby permitting removal of the chock.

The signal from one of the elevating jack pinion gear units for each cord of the leg identifies the required elevation of the chock to mate with the leg cord rack. This vertical position is provided by an actuator.

At the proper elevation, the toothed member is moved into mating its teeth with the leg cord rack teeth. This operation is done simultaneously for both sides of the leg cord rack such that there is no opposing force once engaged.

A position and load indicating sensor provides a signal to confirm completion of the step of engaging each chock with the teeth on each leg.

A sequencing controller in the jacking control room identifies that the chock is installed. Linear actuators then engage the wedges into contact with the chock at one surface and with the wedge shaped support portions of the hull. Since the upper or lower wedges must normally travel farther than the other, a load sensor is provided to stop the movement of the first to make contact until the other makes contact. When both the upper and lower wedges on both sides are in contact, the actuator is energized to a higher load level to ensure that the chock is firmly seated.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
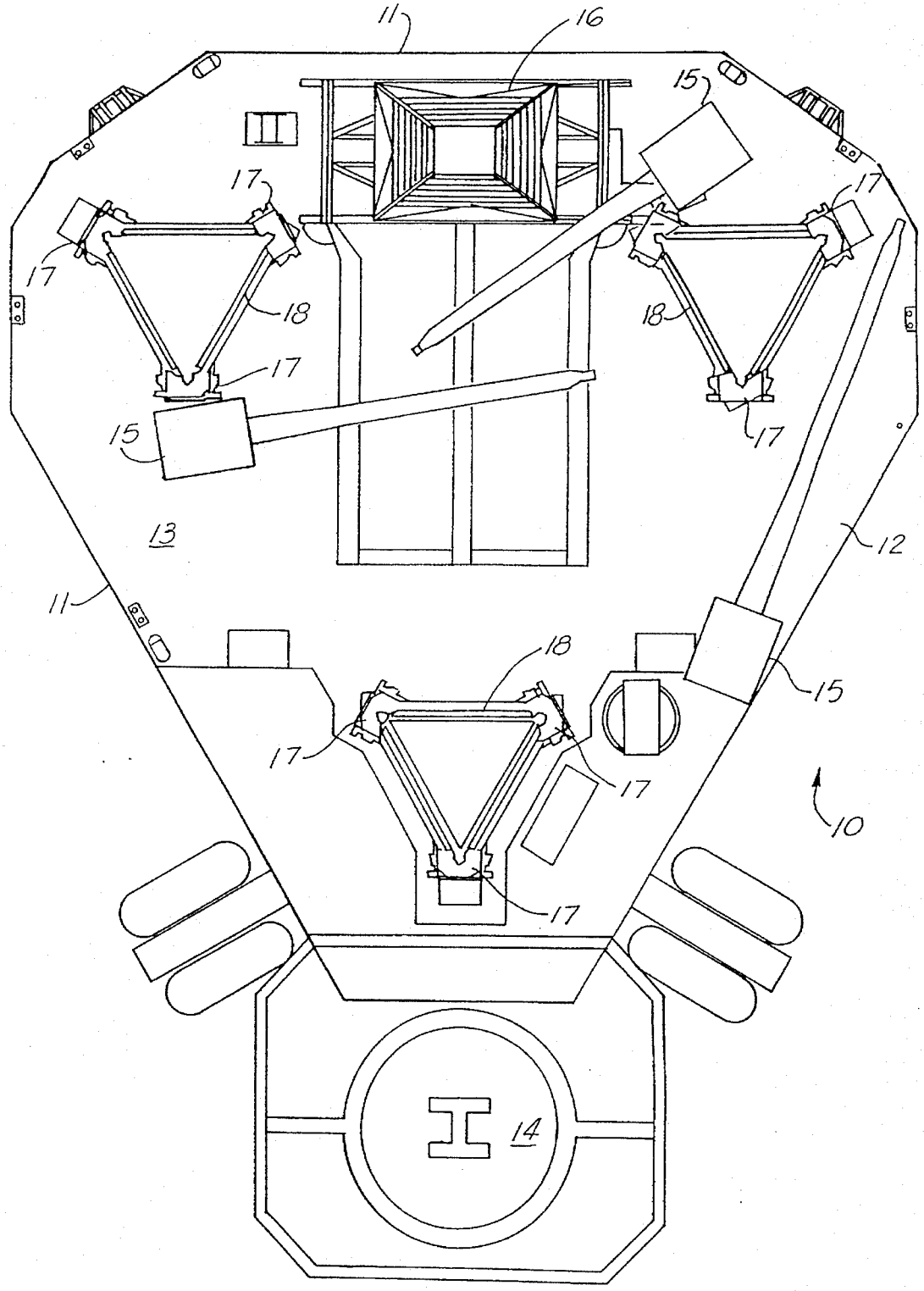
FIG. 1 is a top, plan view illustrating a typical jack-up unit.

FIGS. 1–4 illustrate the preferred embodiment of the apparatus of the present invention designated generally by the numeral 10. A typical jack-up unit 11 is shown in FIG. 1. Jack-up units 11 are well known in the art. Such units have a barge or hull 12 having a deck 13. The deck 13 can be very large, often having a heliport 14 for landing helicopters that transfer men and material to the unit 11 during use. The deck 13 usually include a number of lifting cranes 15, each having an elongated boom as shown. The jack-up unit 11 illustrated in FIG. 1 is an oil and gas well drilling platform, having a drilling derrick 16.

In FIG. 1, the jack-up unit 11 provides three legs, each having a plurality of jack tower 17 as shown. The legs 18 are in the nature of elongated truss member as is known in the art.

Figure 2:
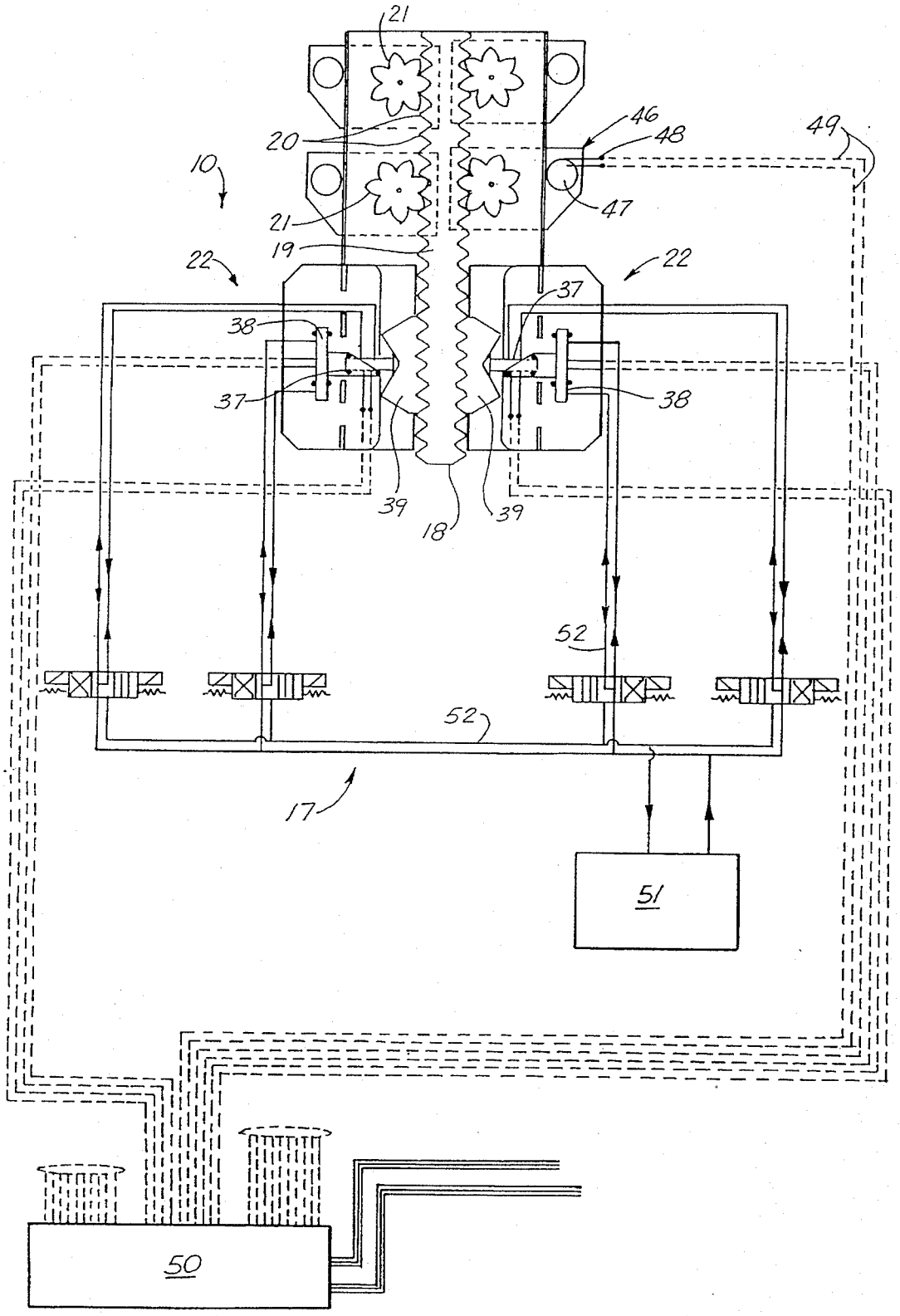
FIG. 2 is a partial elevational view of the preferred embodiment of the apparatus of the present invention in the engaged position.

In FIG. 2, the improved locking apparatus 10 of the present invention is shown in detail adjacent to the jacking apparatus that is known in the art for elevating the barge relative to the legs 18. In FIG. 2, a plurality of elevating pinions 21 are shown as part of the jacking tower 17. Each leg 18 provides a chord rack 19 with a plurality of teeth 20. Each of the teeth 20 engages the elevating pinion 21. The pinion 21 has a plurality of teeth that correspond to and mesh with the teeth 20 of the chord rack 19 as shown in FIG. 2. It should be understood that the use of elevating pinions 21, chord racks 19, and the teeth of chord racks 19 as a means of raising and lowering the hull 12 of a jack-up unit are old and well known in the art.

The method of fixing the legs 18 of the jack-up unit to the hull 12 of the jack-up unit includes the step of first lowering the legs 18 to engage the sea bottom. The legs are then preloaded to storm load conditions using ballast for example. The preload is then dumped, and the hull elevated to an operating position. A connection is then formed between the teeth 20 of each leg chord rack and its jack tower using the remote and automatic fixation unit of the present invention, according to the improved method of the present invention. Using the method of the present invention, the teeth 20 of chord rack 19 can be engaged with out any local visual assistance. The is an improvement over the prior art in that prior art fixation units require a human operator to visually inspect the fixation unit to confirm that alignment has occurred. This can be a time consuming and inaccurate method.

Figure 3:
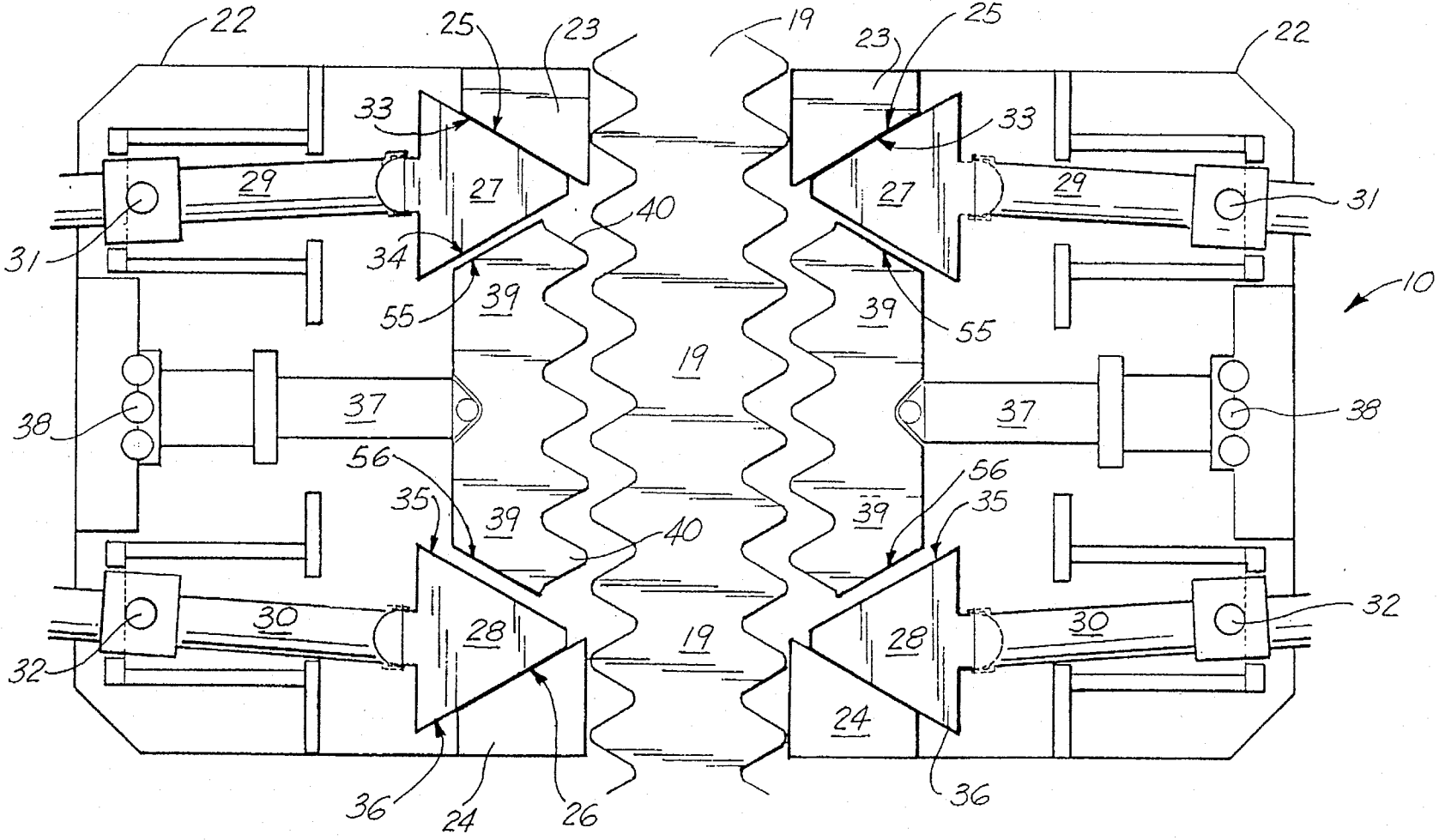
FIG. 3 is a fragmentary elevational view of the preferred embodiment of the apparatus of the present invention in the disengaged position.
Figure 4:
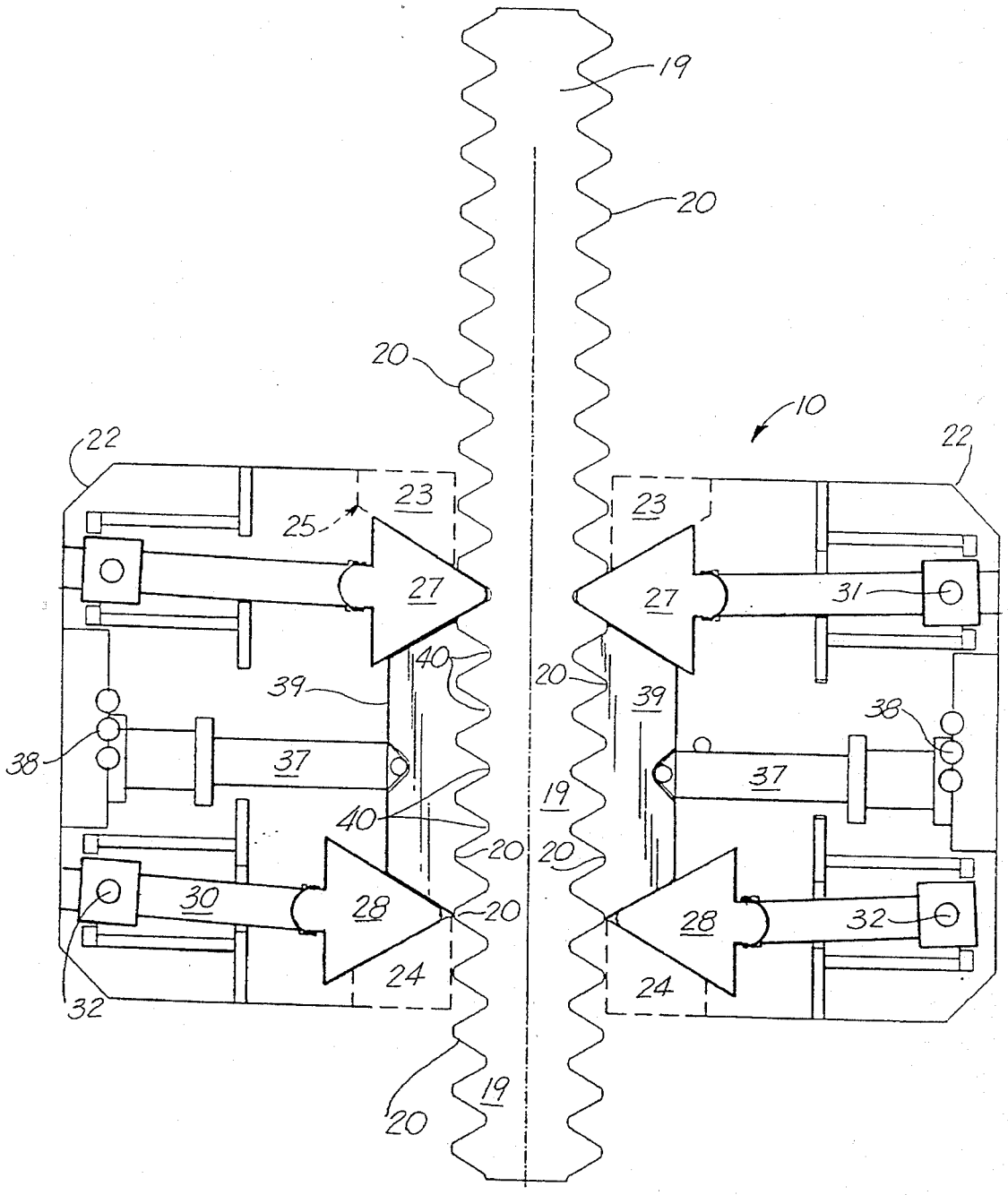
FIG. 4 is a partial elevational view of the preferred embodiment of the apparatus of the present invention in the engaged position.
Figure 5:
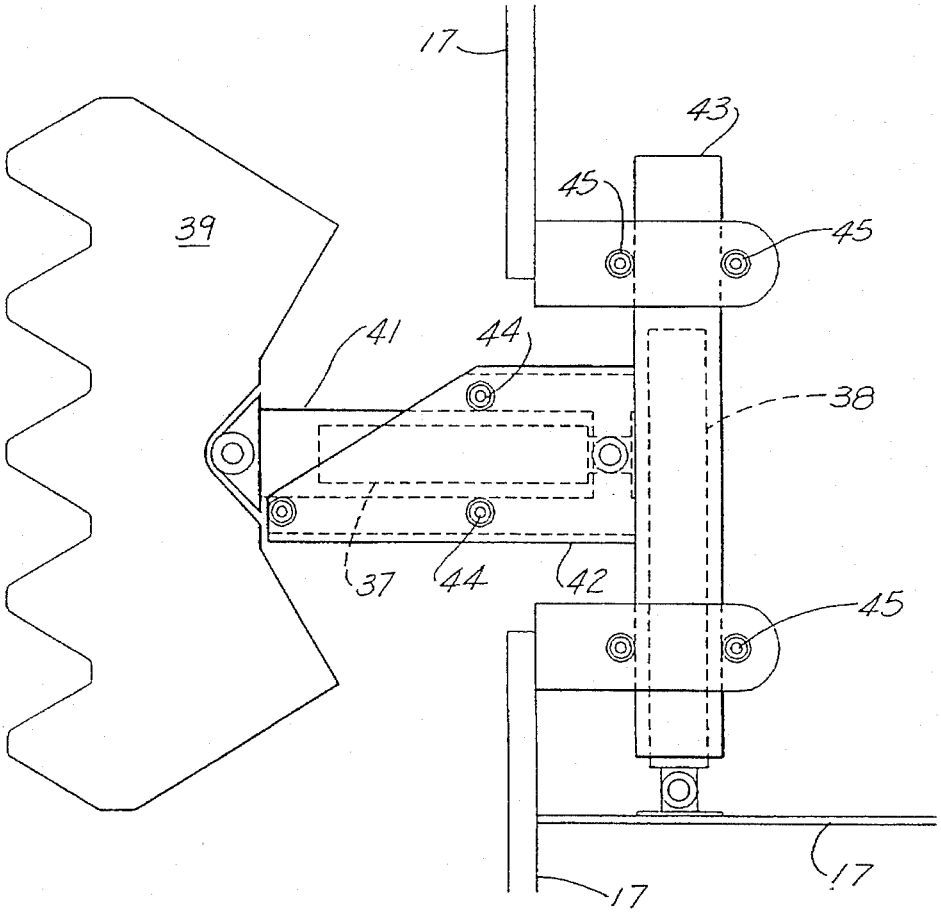
FIG. 5 is a fragmentary elevational view of preferred embodiment of the apparatus of the present invention in the disengaged position.

In FIGS. 2–4, fixation unit 22 portion of the present invention is shown in more detail. In FIGS. 2 and 4, a engaged position is shown. In FIGS. 3 and 5, a disengaged position is shown.

The jack-up leg 18 includes a leg cord 19 having a pair of opposed rows of teeth 20 as shown in FIGS. 2–4, a dual opposed fixation unit 22 is provided, one for engaging each set of teeth 20, as shown in FIGS. 2–4.

Fixation unit 22 includes upper and lower supports 23, 24 that are fixed to and part of the jack tower 17, by welding for example. For purposes of design, the upper support 23 and the lower support 24 form a part of the jack tower 17, transferring load thereto during use. The upper support 23 has a lower, inclined surface 25. The lower support 24 has an upper inclined surface 26. The two surfaces 25, 26 of the upper and lower supports 23, 24 respectively form an acute angle.

The fixation unit 22 includes a pair of moving wedges including upper wedge 27 and lower wedge 28. The upper moving wedge 27 is guided such that its surface 33 is maintained in contact and slides against the upper support 23 inclined surface 25. The lower moving wedge 28 is maintained in contact with and slides against the lower support 24 inclined surface 26. Inclined surface 33 of upper wedge 27 is sized and shaped to engage inclined surface 25 of upper support 23. Inclined surface 36 of lower wedge 28 is sized and shaped to engage inclined surface 26 of lower support 24. Each wedge 27, 28 is moved by its own linear actuator 29, 30. Upper linear actuator 29 attaches pivotally to jack tower 17 at connection 31. Lower linear actuator 30 connects to jack tower 17 at lower connection 32. In the preferred embodiment, the connections 31, 32 are pivotal connections. Upper and lower linear actuators 29, 30 can be self-locking, screws or hydraulic linear actuators for example. Each wedge 27, 28 provides a pair of inclined surfaces 33, 34 and 35, 36 respectively. The surfaces 33, 34 of upper wedge 27 form an acute angle. Similarly, the inclined surface 35, 36 of lower wedge 28 form an acute angle.

The first step of engagement of the chord chock 39 with the chord rack 19 teeth 20 uses linear actuators 38, 37. Another method would be to use rotary actuators. The moveable toothed chock 39 is supported by an extendable horizontal boom 41 which rides on rollers 44 and moved by actuator 37 which is attached to vertical boom 43. The rollers 44 are supported by a horizontal member 42 which is attached to and part of the vertical boom 43. The vertical boom 43 rides on rollers which are supported by the jack tower 17 and is moved vertically by the actuator 38 which is supported by the jack tower 17.

The vertical actuator 38 is preferably a positioning, feed back device which receives a signal to elevate to a given level and goes to that level and maintain that level. The signal to actuator 38 is derived from the gear elements of the elevating pinion jacks 21. One device is provided for each jack tower 17, totaling three devices for a three chord leg, four devices for a four chord leg etc., is provided to identify the position of the leg chord's 19 teeth 20 relative to the movable chock 39. A suitable such device of this type is the "Eaton Durant Electric Positioning Controller", a commercially available device.

When the vertical boom 43 has been elevated by the vertical positioning actuator 38 to the proper level and in turn elevated the horizontal member 42, horizonal boom 41 and chock 39, the horizontal positioning actuator 37 can then move the chock 39 into engagement with the leg chord 19 teeth 20.

The actuator for moving the vertical and horizontal booms may be hydraulic, or motor drive screws.

In order to engage the locking apparatus 10 of the present invention, the user (e.g., with a computer) first activates the indexing actuator 37 (for example a hydraulic linear actuator) by extending the actuator 37 to move the chock 40 into the position shown in FIG. 4.

The method of the present invention provides an improved method for automatically and remotely fixating the rig legs 18 to the barge or hull 12 at the jack towers 17.

A position and load indicating sensor provides a signal to confirm completion of this step. A sequencing controller in the jacking-control room identifies that the chock 39 is installed. The sequencing controller then actuates the upper and lower linear actuators 29, 30 to move the upper and lower wedges 27, 28 into contact with the chock 39 sliding on the upper and lower supports 23, 24 respectively.

In the engaged position, the upper wedge inclined surface 34 engages inclined surface 55 of chock 39. Similarly, in the engaged position the upper inclined surface 35 of lower wedge 28 engages the lower inclined surface 56 of chock 39.

During use, the upper or lower wedge 27, 28 may travel farther than the other. A load sensor is provided to stop the movement of the first wedge to make contact until the other wedge makes contact with the above described inclined surfaces. When both the upper and lower wedges on both sides are fully in contact with the appropriate inclined surface, the upper and lower linear actuators 29, 30 are energized to a higher load level to insure that the upper and lower wedges and the chock are firmly seated and properly indexed.

With the method of the present invention, the rotational position of the pinion gear 21 is used to define the position of the leg chord rack teeth 20 relative to the pinion gear 21 teeth. In FIG. 2, each pinion gear 21 has an associated reduction gear 46. Reduction gears 46 are typically used in the art in combination with pinion gears as part of the elevating system of a jack-up unit. Elevation jacks are part of the jack-up towers 17 that include motors in combination with reduction gears 46.

The method of the present invention simply adds a ring gear 47 to the reduction gear 46. Position probes 48 (such as supplied with an Eaton Durant Electronic Positioning Controller) counts circumferentially placed spaces on the outer periphery of the ring gear as the ring gear rotates with the reduction gear 46. A proximity switch counts the circumferentially placed spaces of the ring gear, maintaining a summary of these counted positions.

The summary of positions as compared to the toothed positions of the leg chord rack 19 relative to the stroke that elevates the chord chock 39. An additional benefit from this system would be to identify leg penetration, knowing the water depth and also identifying the air gap (distance between the bottom of the hull and the water surface) when elevated.

Figure 6:
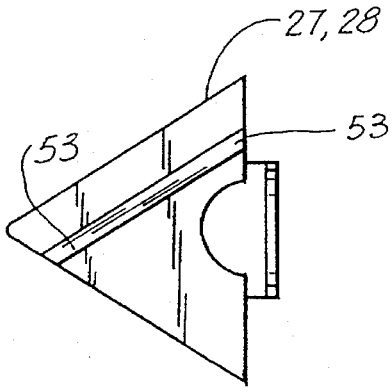
FIGS. 6 and 7 are fragmentary side and end views illustrating the wedge member and guide rail portions of the preferred embodiment of the apparatus of the present invention.
Figure 7:
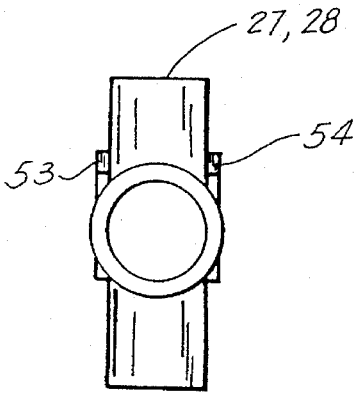

In FIGS. 6–7, a typical wedge member 27, 28 is shown. Each wedge member 27, 28 has a rail 53, 54 on each side as shown. The rails 53, 54 insure that the wedge surface 25 registers against the surface 33 of support 23. Similarly, wedge 28 has rail 53, 54 that are parallel to surface 36 to insure that surface 36 registers against surface 26 of support 24. Each rail 53, 54 travels in a correspondingly sized and shaped channel (not shown) on the jacking tower 17.

The following table lists the parts numbers and parts descriptions as used herein and in the drawings attached hereto.

PARTS LIST

| Part Number | Description |
|---|---|
| 10 | locking apparatus |
| 11 | jack up unit |
| 12 | barge |
| 13 | deck |
| 14 | heliport |
| 15 | lifting crane |
| 16 | derrick |
| 17 | jack tower |
| 18 | leg |
| 19 | chord rack |
| 20 | teeth |
| 21 | elevating pinion |
| 22 | fixation unit |
| 23 | upper support |
| 24 | lower support |
| 25 | inclined surface |
| 26 | inclined surface |
| 27 | upper wedge |
| 28 | lower wedge |
| 29 | upper linear actuator |
| 30 | lower linear actuator |

-continued

PARTS LIST

| Part Number | Description |
|---|---|
| 31 | connection |
| 32 | connection |
| 33 | inclined surface |
| 34 | inclined surface |
| 35 | inclined surface |
| 36 | inclined surface |
| 37 | indexing actuator |
| 38 | actuator |
| 39 | chock |
| 40 | teeth |
| 41 | horizontal boom |
| 42 | horizontal member |
| 43 | vertical boom |
| 44 | roller |
| 45 | roller |
| 46 | reduction gear |
| 47 | ring gear |
| 48 | position probes |
| 49 | instrumentation lines |
| 50 | control console |
| 51 | hydraulic power unit |
| 52 | hydraulic lines |
| 53 | rail |
| 54 | rail |
| 55 | surface |
| 56 | surface |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A method for fixation the legs of a jack-up unit to the hull of a jack-up unit wherein each leg has a chord rack with teeth engaged by a jack tower having rotary element that elevates and lowers the legs relative to the hull comprising:

a) lowering the legs to engage the sea bottom;

b) preloading the legs to storm load conditions;

c) dumping the preload;

d) elevating the hull to an operating position;

e) forming a connection between the teeth of each leg chord rack and its jack tower rotary element with a remote and automatic fixation unit that enables the user to form the connection without any local visual assistance; and f) using the rotational position of the rotary element to define the position of the leg chord rack teeth relative to the pinion gear teeth.

2. The method of claim 1 wherein the rotary element is driven in part by a reduction gear.

3. The method of claim 2 wherein the summary of positions is compared to the toothed positions of the leg chord rack relative the rotary actuator that elevates the chord chock.

4. The method of claim 3 wherein the leg chord chock is moved vertically with an actuator prior to engagement of the leg chord rack with the chord chock.

5. The method of claim 4 wherein vertical and horizontal actuators adjustably move the leg chord chock during engagement of the chock with the leg chord rack teeth.

6. The method of claim 2 wherein the rotary element is driven in part by a reduction gear and a ring gear with circumferentially placed spaces is supported within the reduction gear.

7. The method of claim 2 wherein the rotary element has circumferential spaces thereon and a proximity switch counts the circumferentially placed spaces of the rotary element.

8. The method of claim 7 further comprising the step of maintaining a summary of the counted positions.

9. The method of claim 8 wherein it is further provided the step of maintaining a summary of the counted positions, said summary of the counted positions establishing the elevation of the leg rack and the rack teeth within the engagement position of the leg chord chock.

10. The method of claim 2 wherein the actuator is linear.

11. The method of claim 2 wherein the leg chord chock is moved with rotary motion.

12. The method of claim 1 wherein rotary motion is used and parallel bars are fitted to maintain the chock vertical at any position.

13. The method of claim 1 wherein the chock actuators have sensors that provide feed back to the control system which maintains the chock position relative to the leg rack teeth within the engagement position.

14. The method of claim 13 wherein the position is both horizontal and vertical.

* * * * *